313-422 SR
6/4/85 OR 4,521,714

United States Patent [19]

Vaccaro et al.

[11] Patent Number: 4,521,714

[45] Date of Patent: Jun. 4, 1985

[54] SHIELDED ELECTRON BEAM GUIDE ASSEMBLY FOR FLAT PANEL DISPLAY DEVICES

[75] Inventors: Frank E. Vaccaro, East Brunswick; John Kowalik, Trenton, both of N.J.

[73] Assignee: RCA Corporation, Princeton, N.J.

[21] Appl. No.: 447,141

[22] Filed: Dec. 6, 1982

[51] Int. Cl.[3] ..... H01J 29/74; H01J 19/40

[52] U.S. Cl. ..... 313/422; 313/348

[58] Field of Search ..... 313/422, 411, 412, 414, 313/240, 348

[56] References Cited

U.S. PATENT DOCUMENTS

| | | | |
|---|---|---|---|
| 3,935,500 | 1/1976 | Oess et al. | 313/414 X |
| 3,962,599 | 6/1976 | Say | 313/414 X |
| 4,117,368 | 9/1978 | Marlowe et al. | 313/422 |
| 4,131,823 | 12/1978 | Credelle | 313/422 |
| 4,330,735 | 5/1982 | Leedom | 313/422 |

*Primary Examiner*—Palmer Demeo
*Assistant Examiner*—Sandra L. O'Shea
*Attorney, Agent, or Firm*—E. M. Whitacre; D. H. Irlbeck; L. L. Hallacher

[57] ABSTRACT

A beam guide assembly for a flat panel display device includes a plurality of meshes arranged in a spaced parallel relationship. Insulative supports permanently retain the meshes in a desired spaced relationship. Shields are arranged between the various meshes to shield the beam guide assembly from external electric fields and to prevent the insulative supports from being charged by stray electrons and deleteriously effecting the paths of the electron beams.

18 Claims, 2 Drawing Figures

SHIELDED ELECTRON BEAM GUIDE ASSEMBLY FOR FLAT PANEL DISPLAY DEVICES

BACKGROUND OF THE INVENTION

This invention relates generally to flat panel display devices and particularly to a shielded electron beam guide assembly for such devices.

U.S. Pat. No. 4,330,735 discloses a beam guide assembly for a flat panel display device in which a pair of beam guide meshes, a focus mesh and an acceleration mesh are held in a spaced parallel relationship by a plurality of insulative supports which are spaced along the edges of the meshes for the full length of the assembly. Beam guide assemblies fabricated in accordance with the disclosure of the referenced patent are advantageous because the meshes of which the assembly is comprised are accurately and permanently held in the desired space relationships. Also, the lengths of the supports can be carefully controlled thereby assuring uniform spacing of the mesh assemblies from the baseplate upon which they rest. However, some difficulty can arise because the transverse dimension of the mesh assemblies typically is small, for example in the order of 1.0 to 1.25 inch (2.54 to 3.175 cm). Accordingly, in a color display device utilizing three electron beams, the two outside beams are in the close proximity of the insulative supports. For this reason, stray electrons from the beams, or from other sources such as field emission, sometimes impinge upon and negatively charge the insulative supports. Such charges adversely affect the trajectories of electron beams which are traveling toward the screen. Additionally, electric fields and components external to the beam guide assemblies can adversely affect the trajectories of electrons within the beam guide assemblies.

The instant invention overcomes this difficulty by the provision of shields which maintain uniform electric fields within the beam guide assemblies and which prevent stray electrons from impinging upon the insulative support members thereby preventing the support members from becoming electrically charged.

SUMMARY OF THE INVENTION

An electron beam guide assembly for a flat panel display device which is divided into a plurality of electron beam propagation channels. Each beam guide assembly includes a pair of parallel spaced electron beam guide meshes. The meshes include at least one column of apertures for propagating electron beams longitudinally along the channels. An additional mesh is arranged parallel to and spaced from the beam guide meshes. A plurality of support members span the spaces between the beam guide meshes and the additional meshes and fixedly engage the mesh edges to retain the parallel relationship of the meshes. A shield which is arranged along the additional mesh and the beam guide meshes, is fixedly held by the support members at positions displaced along both sides of the column of apertures.

DETAILED DESCRIPTION OF THE PREFERRED EMBODIMENT

Figure 1:
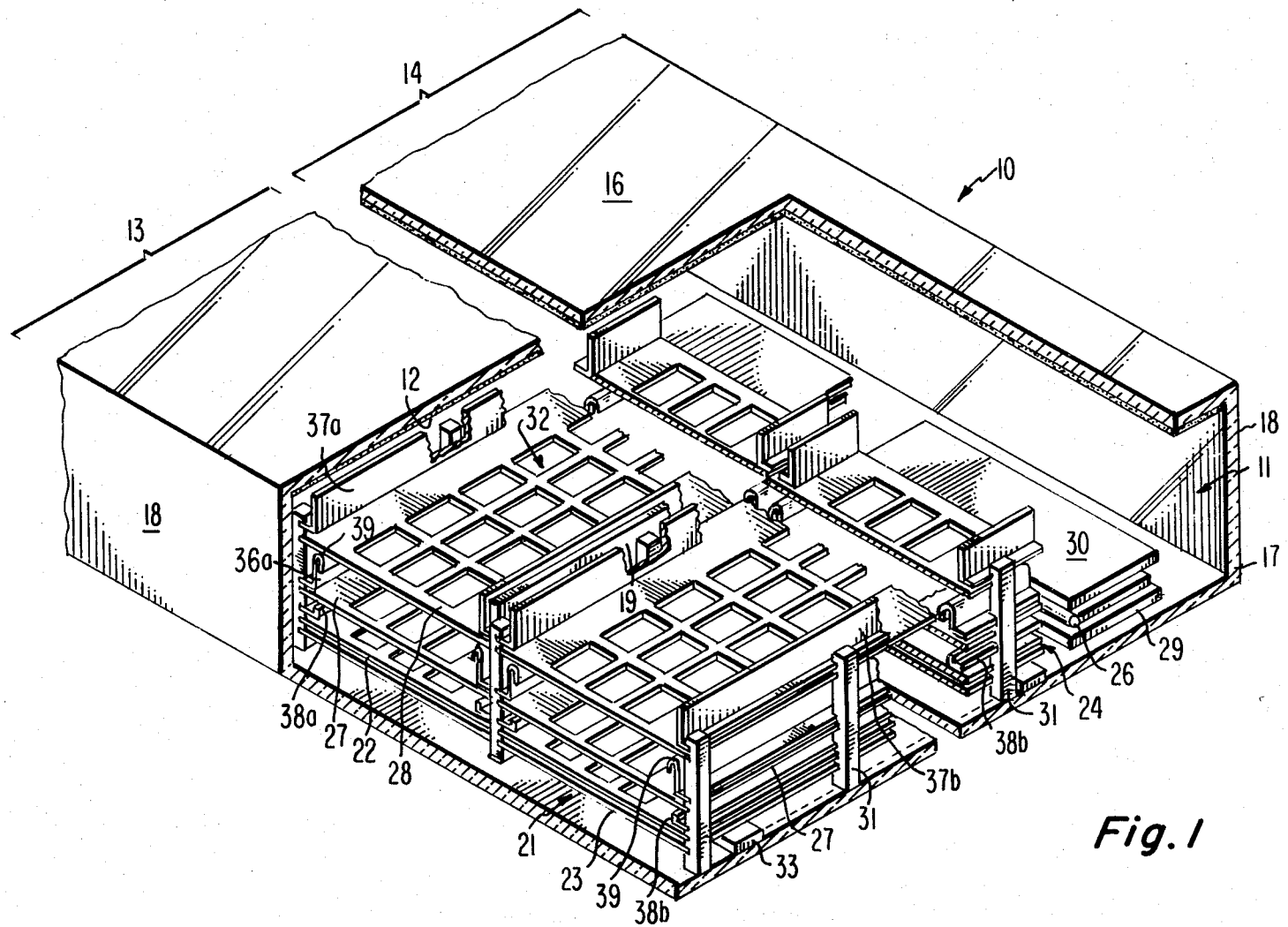
FIG. 1 is a perspective view, partially broken away, of a flat panel display device incorporating the preferred embodiment.

In FIG. 1, a flat panel display device 10 incorporating the preferred embodiment includes an evacuated envelope 11 having a display section 13 and an electron gun section 14. The envelope 11 includes a faceplate 16 and a baseplate 17 held in a space parallel relationship by sidewalls 18. A display screen 12 is positioned along the faceplate 16 and gives a visual output when struck by electrons.

A plurality of spaced parallel support vanes 19 is arranged between the faceplate 16 and the baseplate 17 to provide the desired internal support against external atmospheric pressure and to divide the envelope 11 into a plurality of channels 21. A beam guide assembly, including spaced parallel beam guide meshes 22 and 23, a focus mesh 27, and an acceleration mesh 28, extends transversely across and longitudinally along each of the channels 21. The meshes 22, 23, 27 and 28 are held in the desired spaced parallel relationship by a plurality of insulative support members 31, which are spaced along the full length of both edges of the meshes. A line cathode 26 is supported between modulation electrodes 29 and 30 to emit electrons into the spaces 24 between the guide meshes 22 and 23 in each channel 21 so that the electrons propagate the lengths of the channels. The channels 21 each include an electron gun for the three colors used to produce a color display. The electron guns include a portion of the line cathode and the modulation electrodes 29 and 30 which are biased to cause electrons to enter the spaces 24. Each of the meshes 22, 23, 27 and 28 contains a plurality of apertures 32, which are arranged in columns longitudinally along the meshes and in rows transversely across the meshes. Disposed on the inside surface of the back plate 17 is a plurality of extraction electrodes 33, which extend transversely across the entire transverse dimension of the envelope 11. When a particular horizontal line of the visual display is to be displayed on the display screen 12, a negative voltage is applied to one of the extraction electrodes 33 and the electrons are ejected from between the guide meshes 22 and 23 of every channel and travel to the screen 12 to produce one line of the visual display. Accordingly, each of the channels 21 contributes to the entire horizontal line of the visual display.

Figure 2:
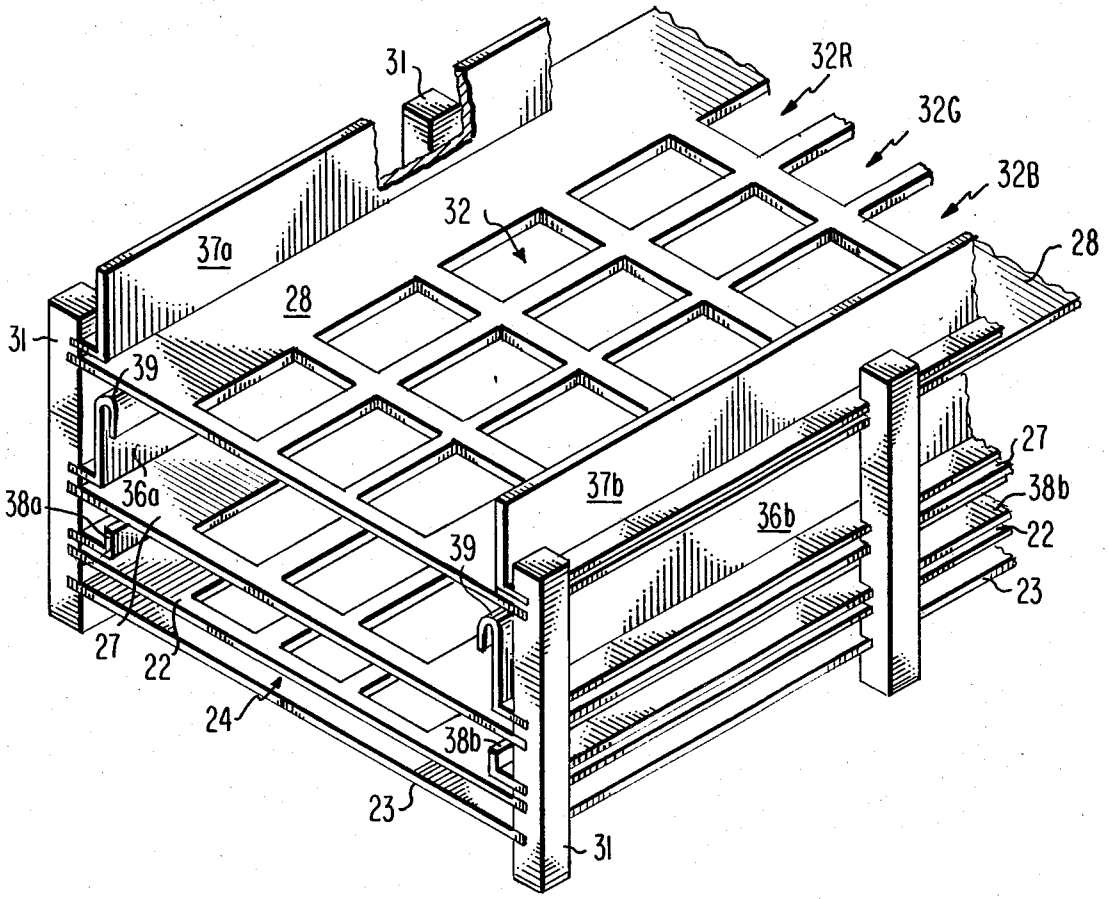
FIG. 2 is a perspective view of a preferred embodiment.

In FIG. 2, when a color display is to be produced utilizing one electron beam for each of the three colors red, green and blue, three columns 32R, 32G and 32B of the apertures 32 are arranged longitudinally along the meshes 22, 23, 27 and 28 so that three transversely adjacent electron beams are propagated in each of the channels. The meshes 22, 27 and 28 are biased at different positive voltages and, therefore, the support members 31 typically are insulative to avoid electrically connecting the various meshes. Accordingly, as the electron beams travel between the various meshes, stray electrons from the beams, or field emission electrons from sources external to the beam guide assemblies, can impact the supports 31. Because the supports are nonconductive, stray electrons collect on the supports and build up charges. The supports 31 are in close proximity to the beams which propagate in the outer columns 32R and 32B, and for this reason, charges on the supports 31 can have a detrimental effect on the trajectories of the outer beams. Additionally, the electric fields between the various meshes of the beam guide assembly can be distorted by electric fields external to the beam guide assembly. For example, the internal support walls 19 are dielectric and support electrodes which are used to scan the electron beams transversely across the channels. Nonuniformities in either of these components can distort the fields within the beam guide assembly and adversely affect the trajectories of beams traveling within the assembly. Charging of the supports 31 and the adverse affects of external electric fields can be prevented by the provision of shields between the various meshes which form the assembly. The shields are biased to various voltages as explained hereinafter.

In FIG. 2, a first pair of conductive shields 36*a* and 36*b* is arranged between the focus mesh 27 and the acceleration mesh 28 for substantially the full length of the meshes and along both edges of the meshes. The shields 36*a* 36*b* are formed into a J-shaped cross-sectional configuration and are permanently imbedded in the supports 31. The shields 36*a* and 36*b* are oriented between the meshes 27 and 28 with the curved portions 39 facing upwardly toward the acceleration mesh 28 and to curve inwardly toward the columns of apertures 32R, 32G, 32B.

In operation of the guide mesh assembly, the meshes 27 and 28 are biased at substantially different voltages and typically the shields 36*a* and 36*b* are biased to substantially the same voltage as the focus mesh 27. Accordingly, a lens is formed between the shields 36*a* and 36*b* and the acceleration mesh 28. The curved portion 39 of the shields 36*a* and 36*b* assures that a smooth uniform surface forms this lens to substantially eliminate the field emission which would occur if a sharp edge faced the acceleration mesh 28. Additionally, because the shields 36*a*, 36*b* and the focus mesh 27 are of substantially the same voltage, the shields can be closer to the mesh 27. The spacing of the shields 36*a*, 36*b* from the acceleration mesh 28 must be larger than the spacing from the focus mesh 27 to prevent electrical arching due to the voltage difference. The shields 36*a* and 36*b* therefore extend for approximately 70% of the spacing between the focus mesh 27 and the acceleration mesh 28, and the spacing between the shields and the acceleration mesh 28 is approximately 3 times the spacing between the shields and the focus mesh 27.

A second pair of shields 37*a* and 37*b* are also embedded in the insulative supports 31 and are arranged between the acceleration mesh 28 and the screen 12 for substantially the full length of the beam guide assembly. The shields 37*a* and 37*b* extend upwardly toward the screen 12 (FIG. 1) for a distance which is small relative to the distance between the acceleration mesh 28 and the screen 12. Accordingly, any electric field which exits is weak and any roughness on the edges of the shields has minimum field emission and little, if any, effect on the electron beams. The shield edges, therefore, are not curved in the same manner as the shields 36*a* and 36*b*. The shields 37*a* and 37*b* typically are biased to the same voltage as the acceleration mesh 28. As described in U.S. Pat. No. 4,131,823 when a color display is to be formed, the two beams which are ejected from the outer columns 32R and 32B must be converged toward the beam from the central column 32G. The converged beams are scanned transversely across the channels to form the individual line segments which comprise a complete horizontal line across the display device. The shields 37*a* and 37*b* can be biased to a voltage which is less positive than the biasing voltage on the acceleration mesh 28. When biased in this manner, the shields 37*a* and 37*b* tend to converge the electron beams toward the desired point above the mesh 28. Alternatively, a scanning wave form of the type described in U.S. Pat. No. 4,117,368 can be superimposed on the biasing voltage applied to the electrodes 37*a* and 37*b* to scan the electron beams across the channels and form the individual line segments.

A third pair of shields 38*a* and 38*b* can be arranged between the guide mesh 22 and the focus mesh 27. The shields 38*a* and 38*b* typically are biased to the same voltage as the guide meshes 22 and 23 to prevent electrons from impacting the supports 31. The spacing between the meshes 22 and 27 is relatively small and the voltage difference is relatively low, and accordingly any deleterious effects of any rough edges on the shields 38*a* and 38*b* is minimum so that these shields need not be configured in the form of a J, as are the shields 36*a* and 36*b*.

The meshes 22, 23, 27 and 28 form an electrooptic assembly, and therefore, of necessity are made from fine material. For example, the meshes can be etched from 6 mil. cold rolled steel. For this reason, the meshes are easily deformable. Additionally, as described in U.S. Pat. No. 4,330,735, it is essential that the guide meshes 22 and 23 be uniformly spaced above the baseplate 17. The shields 36*a*, 36*b* and 37*a*, 37*b* are beneficial in maintaining the uniform spacing of the guide meshes from the baseplate 17 because the shaped configuration of the shields substantially increases the resistance against deformation. The shields, therefore, can be utilized to hold the beam guide assemblies on the baseplate by pressing against the shields with springs thereby eliminating the necessity of spring loading the more fragile and easily deformed meshes.

What is claimed is

1. An electron beam guide assembly for a flat panel display device having a plurality of electron beam propagation channels and a screen for producing a visual image when struck by electrons ejected from said channels, said beam guide assembly comprising:

a pair of parallel spaced electron beam guide meshes, said meshes including at least one column of apertures for propagating electron beams longitudinally along said channels between said beam guide meshes, and at least one additional mesh arranged parallel to and spaced from said beam guide meshes between said guide meshes and said screen;

a plurality of support members spanning the space between said beam guide meshes and said additional mesh and fixedly engaging the edges of said meshes to retain the parallel relationship of said meshes; and first shield means arranged between said beam guide meshes and said screen, said shield means being fixedly held by said support members at positions displaced along both sides of said column of apertures.

2. The beam guide assembly of claim 1 wherein first shield means is arranged between said additional mesh and said beam guide meshes.

3. The beam guide assembly of claim 1 further including second shield means arranged on the side of said additional mesh opposite from said first shield means.

4. The beam guide assembly of claim 3 wherein said additional mesh is an acceleration mesh.

5. The beam guide assembly of claim 4 further including a focus mesh arranged between said acceleration mesh and said beam guide meshes, and third shield means arranged between said focus mesh and said beam guide meshes.

6. The beam guide assembly of claim 5 wherein said shields means are conductive members extending substantially the full length of said beam guide meshes.

7. The beam guide assembly of claim 6 wherein said support members engage the edges of said meshes.

8. The beam guide assembly of claim 7 wherein at least one of said shield members is formed into a J-cross-section configuration.

9. The beam guide assembly of claim 8 wherein said support members are elongated insulating members spaced along the length of said guide mesh assembly.

10. The beam guide assembly of claim 1 wherein said shields means are conductive members extending substantially the full length of said beam guide meshes.

11. The beam guide assembly of claim 10 wherein said support members engage the edges of said meshes.

12. The beam guide assembly of claim 11 wherein at least one of said shield members is formed into a J-like cross-section configuration.

13. The beam guide assembly of claim 12 wherein said support members are elongated insulating members spaced along the length of said guide mesh assembly.

14. The beam guide assembly of claim 1 wherein said additional mesh is a focus mesh.

15. The beam guide assembly of claim 14 wherein said shield means is formed into a J cross-section configuration.

16. The beam guide assembly of claim 5 wherein said shield means is oriented so that the curved portion of said J cross-section shield means curves inwardly away from said support members.

17. The beam guide assembly of claim 3 wherein three transversely adjacent electron beams propagate in each of said channels and wherein said second shield means are voltage biased to converge the outer electron beams toward the center beam.

18. The beam guide assembly of claim 3 wherein said second shield means are biased with a varying voltage to transversely scan said electron beam across said channel.

* * * * *